United States Patent [19]

Steen et al.

[11] Patent Number: 4,781,084

[45] Date of Patent: Nov. 1, 1988

[54] ADJUSTABLE SOCKET-TYPE WRENCH

[76] Inventors: Carson D. Steen; Robby W. Steen, both of 402 Tillman Rd., Fort Mill, S.C. 29715

[21] Appl. No.: 89,314

[22] Filed: Aug. 25, 1987

[51] Int. Cl.[4] ..... B25B 13/28

[52] U.S. Cl. ..... 81/111; 81/125

[58] Field of Search ..... 81/111, 125, 121.1, 81/120, 119, 113, 114, 185.2, 185; 279/35, 36, 56

[56] References Cited

U.S. PATENT DOCUMENTS

| | | | |
|---|---|---|---|
| 66,585 | 7/1864 | Harvey . | |
| 1,022,761 | 4/1912 | Stvanek | 81/111 |
| 1,056,084 | 3/1913 | Bates . | |
| 2,532,972 | 12/1950 | Vertin . | |
| 2,764,050 | 9/1956 | Leibowitz . | |
| 4,235,134 | 11/1980 | McLendon . | |
| 4,643,053 | 2/1987 | Rhodes . | |

OTHER PUBLICATIONS

KP Industries, Adjustable Oil Filter Wrench, Model 7-6017 (Package).

Easco/K-D Tools, End Cap Oil Filter Wrench, Model 2790 (Package).

KA Star, Oil Filter Wrench, Model 630 (Package).

*Primary Examiner*—Frederick R. Schmidt

*Assistant Examiner*—Maurina Rachuba

*Attorney, Agent, or Firm*—Shefte, Pinckney & Sawyer

[57] ABSTRACT

An adjustable socket-type oil filter wrench having a cup-like socket member for receiving an oil filter cartridge, a plurality of pivotable gripping arms circumferentially spaced about the socket member for radially inward and outward relative movement, and a cam arrangement for producing coordinated pivotal movement of the gripping arms for progressive gripping engagement with the circumferential periphery of an oil filter cartridge to apply removal torque thereto. The pivotal dispostion of the gripping arms enables the wrench to be used with oil filters of all conventional sizes.

8 Claims, 3 Drawing Sheets

ADJUSTABLE SOCKET-TYPE WRENCH

BACKGROUND OF THE INVENTION

The present invention relates generally to an adjustable socket-type wrench and, more particularly, to such tools particularly configured and adapted for the removal of an oil filter cartridge such as conventionally utilized on automobile and like engines.

As is well known, substantially all modern automobile and like internal combustion engines.are provided with a threaded connection on the engine block for mounting of an oil filter cartridge for removing dirt and other debris and foreign matter from the lubricating oil as it is circulated through the engine cavities during operation. Draining and change of the lubricating oil from the engine, together with replacement of the oil filter cartridge, is a routine engine maintenance procedure which ordinarily must be performed at least once or more a year, depending upon the frequency and duration of normal engine operation.

While oil and filter cartridge replacement is intended to be a simple procedure to accomplish, it is common for the threaded connection between the filter cartridge and the engine to become frozen as a result of repetitive heat expansion and contraction of the engine and cartridge and the possible accumulation of debris in the threaded connection. Thus, although manufacturers typically recommend that oil filter cartridges be installed only by hand tightening, it is frequently impossible to remove a filter cartridge by hand after a period of use.

As a result, a number of tools of varying constructions have been developed for the specific purpose of creating a mechanical advantage in manually applying removal torque to an oil filter cartridge to loosen its threaded connection to an automobile engine. Perhaps the most common such tool currently in use has an elongate handle with a circular band or strap at one end for encircling and frictionally engaging the periphery of the oil filter cartridge for operation as a wrench-like tool to apply torque to the cartridge. Other conventional tools are configured as a full or partial cap adapted to fit over the outwardly exposed end of an oil filter cartridge for rotational operation by a conventional socket wrench handle or similar drive tool for applying removal torque to the filter cartridge. Other specialized oil filter tool constructions have also been proposed, such as disclosed in U.S. Pat. No. 4,643,053. Disadvantageously, however, such conventional tools sometimes do not provide sufficient frictional engagement with the cartridge periphery to avoid slippage of the tool with respect to the cartridge and are therefore sometimes incapable of dislodging an oil filter cartridge. Furthermore, while some of the aforedescribed tools are designed for diametric adjustment, the range of available adjustment is limited to that necessary to accommodate one particular type or size of conventional oil filter cartridge so that such tools are nevertheless incapable of use with all sizes of conventional oil filter cartridges.

It is accordingly an object of the present invention to provide an improved socket-type wrench having a self-adjusting gripping arrangement which is particularly adapted for non-slipping use in removing automotive oil filter cartridges of all conventional sizes.

SUMMARY OF THE INVENTION

Briefly described, the wrench of the present invention comprises a socket member of a cup-like shape for axially receiving at least a portion of the periphery of a rotatable member such as an oil filter cartridge and a plurality of gripping arms pivotably supported by the socket member in axial disposition at circumferential spacings about the socket member for radial movement inwardly and outwardly with respect thereto. A cam member is mounted on the socket member in operative association with each of the gripping arms for reciprocal movement with respect to the gripping arms for actuating coordinated radially inward and outward pivoting movement of the gripping arms into and out of peripheral gripping engagement with a filter cartridge or other rotatable member received within the socket member. A cam operating member is rotatably mounted on the socket member in operative association with the cam member for selectively actuating movement thereof with respect to the gripping arms for pivoting into and out of gripping engagement with the cartridge or rotatable member and for actuating rotational movement of the socket member, gripping arms and cam member unitarily with the cam operating member upon gripping engagement of the gripping arms with the cartridge or rotatable member to rotationally apply operational torque thereto. In this manner, the wrench is capable of self-adjustment of the gripping arms into engagement with oil filter cartridges and other rotatable members of a range of peripheral sizes.

In the preferred embodiment of the present wrench, the cup-like shape of the socket member defines a generally cylindrical interior area particularly adapted for axially receiving one axial end of an oil filter cartridge. At least three of the gripping arms of an elongate configuration are pivotably supported by the socket member at substantially equidistant circumferential spacings about the interior area, with each gripping arm having a cam end disposed within the interior area of the socket member. The cam operating member is threadedly mounted to the socket member coaxially with its interior area for axially reciprocal rotational movement with respect to the socket member, the operating member preferably including a head portion disposed exteriorly of the socket member for engagement by a conventional torque applying tool such as a wrench or the like for actuating rotation of the operating member. The cam member is disposed within the interior area of the socket member and fixed integrally with the operating member for rotational and axial movement integrally therewith. The cam member has a peripheral recessed channel which receives and retains the cam end of each gripping arm and has cam surfaces within the channel for engaging opposite sides of the cam ends to cause coordinated radially inward pivoting of the gripping arms when the operating and cam members are rotated counterclockwise relative to the socket member and gripping arms to move in one axial direction relative thereto and coordinated radially outward pivoting of the gripping arms when the operating and cam members are rotated clockwise relative to the socket member and gripping arms to move in the other axial direction relative thereto. Thus, the tool is operable for selective gripping engagement of the gripping arms with and disengagement thereof from an oil filter cartridge received within the interior area of the socket member and, particularly, when the operating and cam members are rotated counterclockwise, the socket member and gripping arms are arranged to rotate unitarily counterclockwise therewith upon gripping engagement of the gripping arms with an oil filter cartridge to rotationally apply counterclockwise removal torque thereto.

DESCRIPTION OF THE PREFERRED EMBODIMENT

Figure 1:
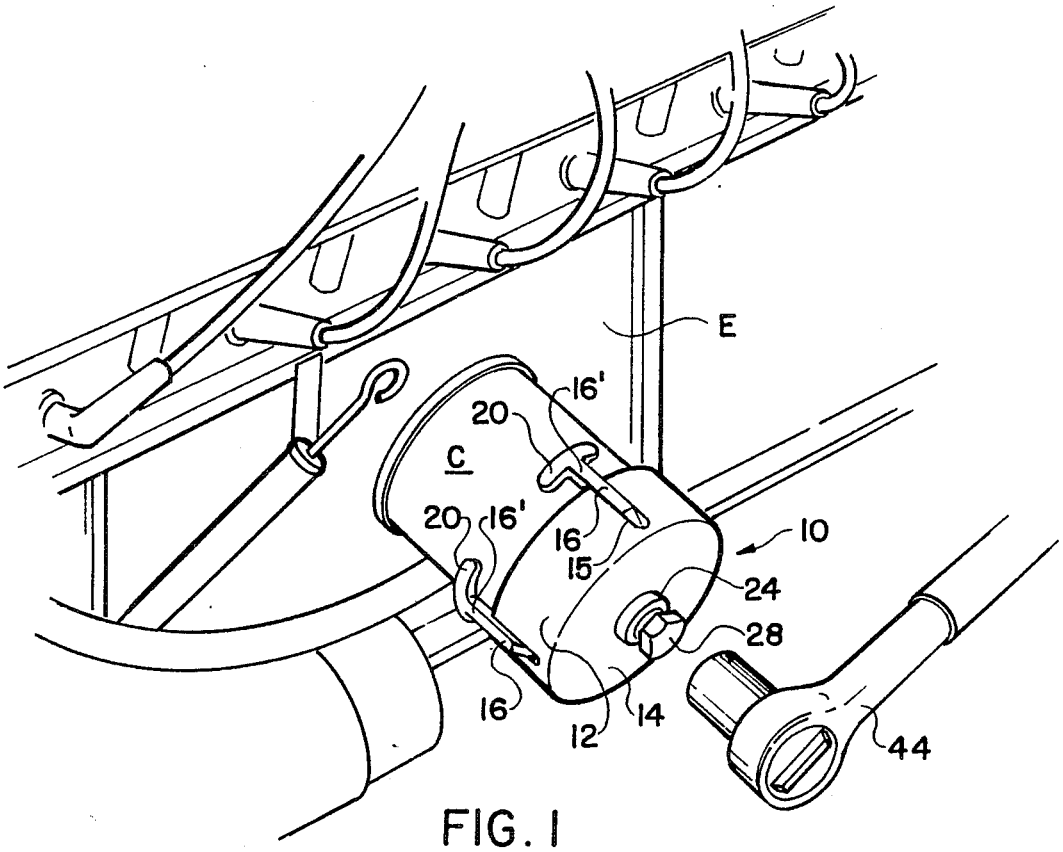
FIG. 1 is a perspective view of the preferred embodiment of the present socket-type wrench shown in operative relationship with a conventional oil filter cartridge mounted on an automotive engine for removal thereof utilizing a compatible conventional socket wrench.

Referring now to the accompanying drawings and initially to FIG. 1, the wrench of the present invention is shown generally at 10 as preferably embodied for particular use in the removal of a conventional oil filter cartridge C from its mounted disposition on the engine block of an automotive or similar internal combustion engine E. The wrench 10 includes a hollow cylindrical body 12 closed at one end by a circular radial end plate 14 and open at the opposite end to form a cup-like socket member within which the closed outward end of the oil filter cartridge C may be coaxially received. As will be understood, conventional oil filter cartridges in current use may range in diameter from approximately three to four inches, with minor variations, and accordingly the interior diameter of the cylindrical body 12 is selected to be slightly greater than the largest currently conventional oil filter cartridge.

Figure 2:
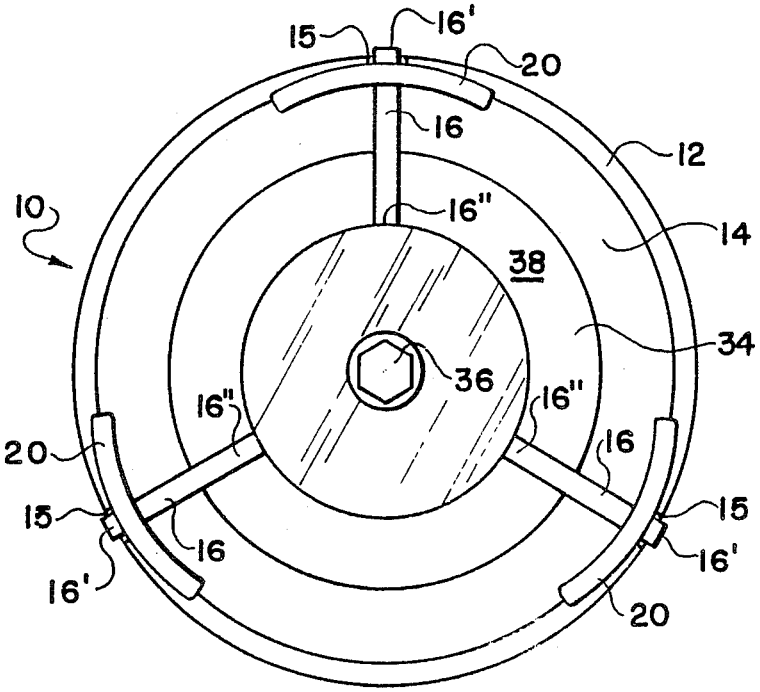
FIG. 2 is a bottom plan view of the present wrench of FIG. 1.
Figure 3:
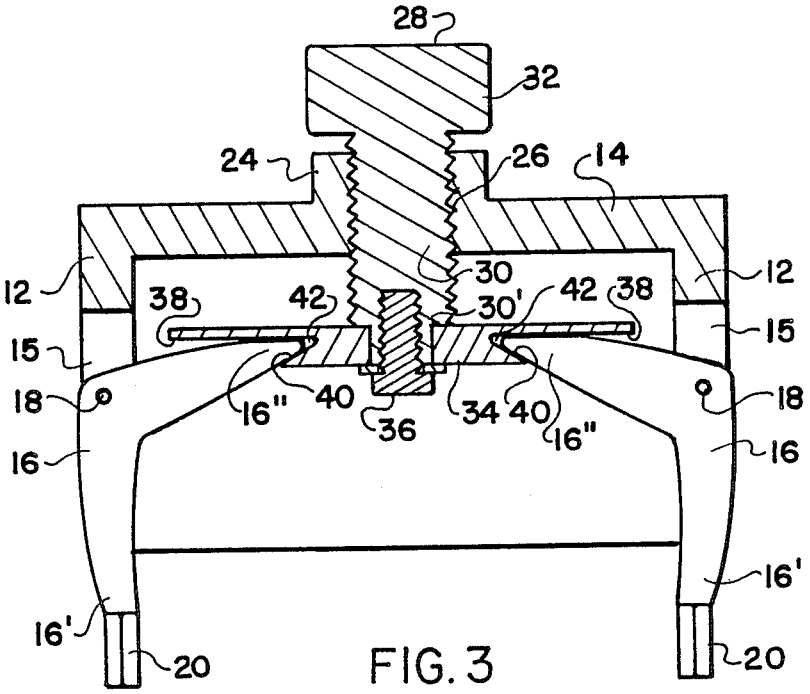
FIG. 3 is a vertical cross-sectional view of the present wrench of FIG. 1 taken through the axis thereof, with one of its gripping arms being shown 60° removed for illustrative purposes.
Figure 4:
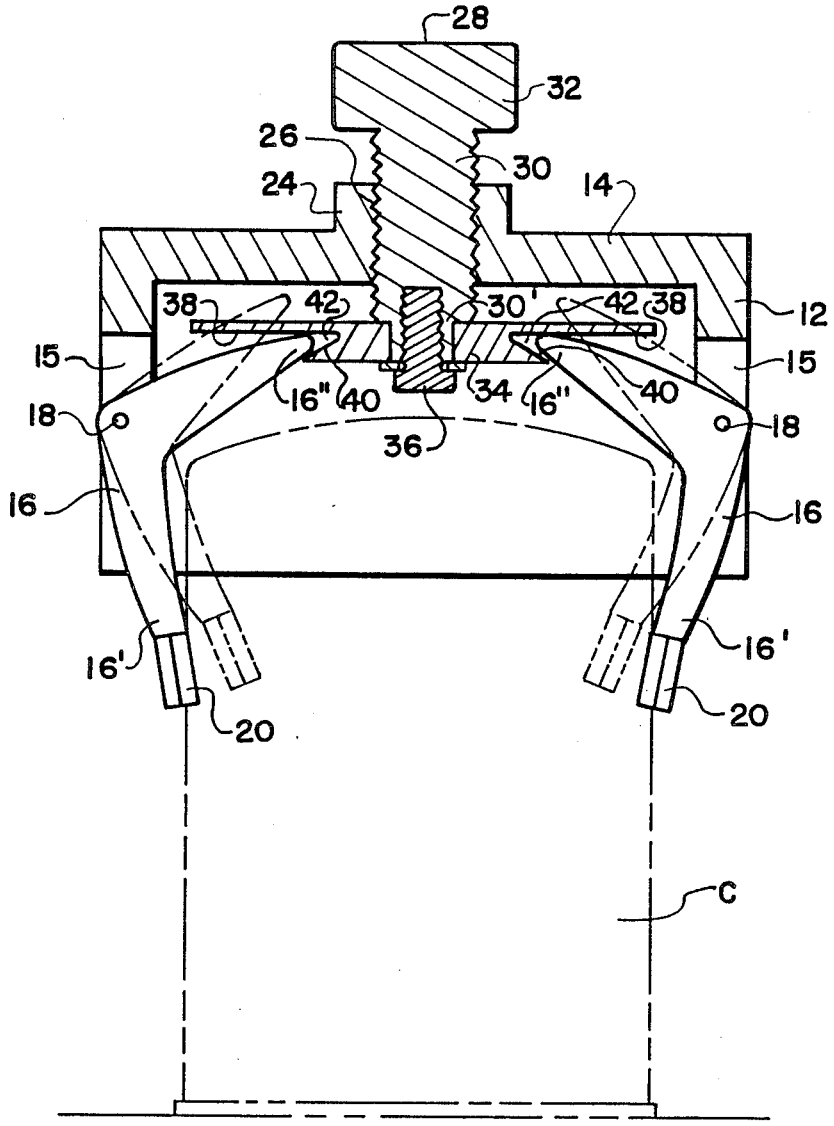
FIG. 4 is another vertical cross-sectional view similar to FIG. 3 showing the gripping arms in a radially inwardly pivoted position.

The cylindrical body 12 is formed with a plurality of at least three elongate linear slots extending axially from the open end of the body 12 at substantially equidistant circumferential spacings thereabout and a corresponding number of elongate gripping arms 16 are pivotably supported by the body 12 respectively within the slots 15 on pivot pins 18 for pivotal movement radially with respect to the body 12, as best seen in FIGS. 2–4. Each gripping arm 16 is of a generally L-shaped configuration mounted at a medial portion on its pivot pin 18 with one end 16' extending generally axially through and from the open end of its slot 15 and the other end 16'' extending generally inwardly into the hollow interior of the body 12. The end 16' of each arm 16 is formed with a laterally extending gripping flange 20 and the inward end 16'' of each arm 16 is taperingly profiled to provide a cam surface.

A support hub 24 is provided at the axial center of the end plate 14 and a threaded bore 26 is formed through the hub 24 and the end plate 14 in alignment coaxially with the cylindrical body 12. A bolt 28 having a threaded shaft 30 and a hexagonal head portion 32 is mounted in threaded engagement within the bore 26 with the head portion 32 of the bolt 28 exposed at the outward side of the hub 24 and with the opposite end 30' of the threaded bolt shaft 30 extending into the hollow interior of the cylindrical body 12. For purposes which will be described and understood more fully hereinafter, the bore 26 and the threaded shaft 30 of the bolt 28 are formed of compatible right-hand threads for axial reciprocation of the bolt 28 toward the open end of the cylindrical body 12 upon clockwise rotation of the bolt 28 (as viewed from the outward side of the end plate 14 as in FIG. 1) and away from the open end of the cylindrical body 12 upon counterclockwise rotation of the bolt 28. A circular cam wheel 34 is fixedly mounted within the hollow interior of the cylindrical body 12 coaxially to the end 30' of the bolt shaft 30 integrally therewith by a left-hand threaded screw 36 received within a correspondingly threaded axial bore in the end face of the bolt shaft 30. The radially outward periphery of the cam wheel 34 is profiled to provide radially inwardly converging annular cam surfaces 38,40 which define therebetween an annular outwardly opening recessed channel 42. The cam end 16'' of each gripping arm 16 is received in the annular channel area 42 and retained therewithin by the converging cam surfaces 38,40.

As will thus be understood, the cam surfaces 38,40 operate on the cam ends 16'' of the gripping arms 16 during integral rotation of the cam wheel 34 with the bolt 28 to produce coordinated radially inward and outward pivoting of the gripping arms. More specifically, upon clockwise rotation of the bolt 28 and cam wheel 34, the cam surface 38 engages the facing side of the cam end 16' of each gripping arm 16 as the cam wheel 34 moves integrally with the bolt 28 toward the open end of the body 12 to simultaneously pivot the gripping ends 16' of the arms 16 radially outwardly with respect to the cylindrical body 12, as seen in FIG. 3. Conversely, upon counterclockwise rotation of the bolt 28 and cam wheel 34 to move integrally away from the open end of the cylindrical body 12, the cam surface 40 of the cam wheel 34 engages the facing side of the cam end 16'' of each gripping arm 16 to actuate simultaneous pivoting of the gripping ends 16' of the arms 16 radially inwardly with respect to the cylindrical body 12, as seen in FIG. 4. The hexagonal head portion 32 of the bolt 28 conveniently permits actuation of integral rotation of the bolt 28 and cam wheel 34 by any conventional torque applying tool such as a common socket wrench tool shown at 44 in FIG. 1 or, alternatively, a compatible open-ended wrench or even an ordinary pair of pliers.

The operation of the wrench 10 for removal of an oil filter cartridge will thus be understood. As seen in FIG. 3, with the bolt 28 and cam wheel 34 rotated to their fullest clockwise extent, the gripping ends 16' of the gripping arms 16 are pivoted radially outwardmost to facilitate receipt of the axial end of an oil filter cartridge C within the hollow interior of the cylindrical body 12. As the assembly of the bolt 28 and cam wheel 34 are then rotated integrally counterclockwise, the gripping ends 16' of the gripping arms 16 are simultaneously pivoted radially inwardly in coordinated fashion into gripping engagement with the circumferential periphery of the oil filter cartridge C. As will be understood, the gripping engagement between the gripping arms 16 and the filter cartridge C thereafter resists further rotation of the bolt 28 and the cam wheel 34 relative to the cylindrical body 12 and gripping arms 16 and, accordingly, as counterclockwise rotation of the bolt 28 and cam wheel 34 continues under the operation of the socket wrench tool 44, the cylindrical body 12 and the gripping arms 16 tend to rotate counterclockwise unitarily with the bolt 28 and cam wheel 34 and, in turn, transmit the torque applied by the socket wrench tool 44 to the oil filter cartridge C to correspondingly apply the counterclockwise torque thereto to dislodge the cartridge C from its clockwise threaded engagement with the engine block E. If the oil filter cartridge C has become unusually firmly lodged in threaded engagement with the engine block E so as to resist counterclockwise dislodgement therefrom, it will be understood that the relative rotation of the bolt 28 and cam wheel 34 with respect to the cylindrical body 12 will continue and will thereby produce further inward pivoting of the gripping ends 16' of the gripping arms 16 for increased frictional engagement with the cartridge periphery until the torque frictionally applied by the gripping arms 16 to the filter cartridge C is sufficient to overcome the engagement between the filter cartridge C and the engine block E. Further, as illustrated in FIG. 4, the pivotal disposition of the gripping arms 16 enable them to self-adjust under the camming actuation of the cam wheel 34 into gripping engagement with oil filter cartridges C of a wide range of varying diameters, whereby the wrench 10 may conveniently be utilized with any size of oil filter cartridge currently in use. Notably, the left hand threaded connection of the screw 36 to the bolt end 30' is effective to resist unintended loosening during the aforesaid rotational operation of the bolt 28 and cam wheel 34 to maintain their desired integral assembly.

The wrench 10 of the present invention will further be understood to provide a number of significant advantages over conventional oil filter wrenches. As indicated above, the progressive gripping action of the gripping arms 16 essentially avoids any tendency of the present wrench to slip with respect to an oil filter cartridge requiring removal, regardless of the degree to which the cartridge may be essentially frozen with respect to the engine block. As also described, the present wrench is self-adjusting to operate on oil filter cartridges of all sizes currently in conventional use. Thus, the conventional necessity that an automotive mechanic be equipped with two or more oil filter wrenches of different sizes is totally avoided by the present invention. Additionally, the present wrench will be understood to be of a simple construction utilizing a minimal number of operating components which not only enables the wrench to be inexpensively manufactured but also provides a sturdy construction which should minimize the likelihood of breakage and the need for periodic replacement, which is a problem with some conventional oil filter wrenches.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An adjustable socket-type wrench for self-adjusted gripping engagement of rotatable members of a range of peripheral sizes for applying torque thereto, comprising:

a socket member of a cup-like shape for axially receiving at least a portion of the periphery of a rotatable member, a plurality of gripping arms pivotably supported by said socket member in axial disposition at circumferential spacings about said socket member for radial movement inwardly and outwardly with respect thereto, cam means arranged in operative association with each of said gripping arms for axially reciprocal movement with respect to said socket member and said gripping arms for actuating coordinated radially inward and outward pivoting movement of said gripping arms into and out of peripheral gripping engagement with a rotatable member received within said socket member, and cam operating means rotatably mounted threadedly on said socket member coaxially therewith and fixed integrally with said cam means for selectively activating axially reciprocal rotational movement of said cam operating means and said cam means with respect to said socket member and said gripping arms for pivoting of said gripping arms into and out of gripping engagement with a rotatable member and for actuating rotational movement of said socket member, gripping arms and cam means unitarily with said cam operating means upon gripping engagement of said gripping arms with a rotatable member to rotationally apply operational torque thereto.

2. An adjustable socket-type wrench according to claim 1 and characterized further by at least three said gripping arms equidistantly spaced about said socket member.

3. An adjustable socket-type wrench according to claim 1 and characterized further in that said cam means includes a recessed area which receives and retains a cam end of each said gripping arm and cam surfaces within said recessed area for engaging opposite sides of said cam ends of said gripping arms to cause radially inward pivoting of said gripping arms when said cam means moves in one axial direction relative thereto and radially outward pivoting of said gripping arms when said cam moves in the other axial direction relative thereto.

4. An adjustable socket-type wrench according to claim 1 and characterized further in that said cam means includes a recessed area which receives and retains a cam end of each said gripping arm and cam surfaces within said recessed area for engaging opposite sides of said cam ends of said gripping arms to cause radially inward pivoting of said gripping arms when said cam means moves in one axial direction relative thereto and radially outward pivoting of said gripping arms when said cam means moves in the other axial direction relative thereto.

5. An adjustable socket-type wrench according to claim 1 and characterized further in that said cam operating means includes a head portion disposed exteriorly of said socket member for engagement by a conventional torque applying tool such as a wrench for actuating rotation of said cam operating means.

6. An adjustable socket-type wrench according to claim 3 and characterized further in that said cam operating means includes a head portion disposed exteriorly of said socket member for engagement by a conventional torque applying tool such as a wrench for actuating rotation of said cam operating means.

7. An adjustable socket-type wrench according to claim 6 and characterized further by at least three said gripping arms equidistantly spaced about said socket member.

8. An adjustable socket-type wrench particularly adapted for self-adjusted gripping engagement of automotive oil filter cartridges of a range of peripheral sizes for applying removal torque thereto, said wrench comprising:

a socket member of a cup-like shape defining a generally cylindrical interior area for axially receiving one axial end of an oil filter cartridge, at least three elongate gripping arms pivotably supported by said socket member in axial disposition at substantially equidistant circumferential spacings about said interior area of said socket member for radial movement of said arms inwardly and outwardly with respect thereto, each said gripping arm having a cam end disposed within said interior area, operating means rotatably mounted threadedly to said socket member coaxially with its said interior area for axially reciprocal movement with respect thereto, said operating means including a head portion disposed exteriorly of said socket member for engagement by a conventional torque applying tool such as a wrench for actuating rotation of said operating means, and cam means disposed within said interior area of said socket member and fixed integrally with said operating means for rotational and axial movement integrally therewith, said cam means having a peripheral recessed channel which receives and retains said cam end of each said gripping arm and cam surfaces within said channel for engaging opposite sides of said cam ends of said gripping arms to cause coordinated radially inward pivoting of said gripping arms when said operating means and cam means are rotated counterclockwise relative to said socket member and said gripping arms to move in one axial direction relative thereto and coordinated radially outward pivoting of said gripping arms when said operating means and cam means are rotated clockwise relative to said socket member and said gripping arms to move in the other axial direction relative thereto, for selective gripping engagement of said gripping arms with and disengagement thereof from an oil filter cartridge received within said interior area of said socket member and for counterclockwise rotational movement of said socket member and gripping arms unitarily with said operating means and cam means upon gripping engagement of said gripping arms with an oil filter cartridge to rotationally apply removal torque thereto.

* * * * *